US007140583B2

(12) United States Patent
Petzl

(10) Patent No.: US 7,140,583 B2
(45) Date of Patent: Nov. 28, 2006

(54) MECHANICAL CHOCK WITH CAMS FOR CLIMBING AND MOUNTAINEERING

(75) Inventor: Paul Petzl, Barraux (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/978,383

(22) Filed: Nov. 2, 2004

(65) Prior Publication Data

US 2005/0145766 A1 Jul. 7, 2005

(30) Foreign Application Priority Data

Jan. 6, 2004 (FR) ..... 04 00056

(51) Int. Cl.
*A47F 5/08* (2006.01)

(52) U.S. Cl. ..... 248/231.9; 248/926

(58) Field of Classification Search ..... 248/231.9, 248/925; 294/95, 96
See application file for complete search history.

(56) References Cited

U.S. PATENT DOCUMENTS

| | | | | |
|---|---|---|---|---|
| 768,897 | A * | 8/1904 | Gunn | 294/28 |
| 3,446,525 | A * | 5/1969 | Jones | 294/1.4 |
| 4,422,607 | A * | 12/1983 | Vallance | 248/694 |
| 4,565,342 | A * | 1/1986 | Grow | 248/231.9 |
| 4,643,377 | A | 2/1987 | Christianson | |
| 4,645,149 | A * | 2/1987 | Lowe | 248/231.9 |
| 5,484,132 | A * | 1/1996 | George et al. | 248/231.9 |
| 5,860,629 | A * | 1/1999 | Reed | 248/231.9 |
| 6,042,069 | A | 3/2000 | Christianson | |
| 6,070,842 | A * | 6/2000 | Sandahl | 248/231.9 |
| 6,273,379 | B1 | 8/2001 | Phillips | |
| 6,375,139 | B1 * | 4/2002 | Murray et al. | 248/231.9 |
| 2005/0037023 | A1 * | 2/2005 | Field | 424/195.15 |
| 2005/0145765 | A1 * | 7/2005 | Petzl | 248/231.9 |

FOREIGN PATENT DOCUMENTS

| | | |
|---|---|---|
| EP | 0 047 232 | 3/1982 |
| GB | 2347360 | 9/2000 |
| WO | WO 02/34091 A1 | 5/2002 |

* cited by examiner

*Primary Examiner*—Korie Chan
(74) *Attorney, Agent, or Firm*—Oliff & Berridge, PLC

(57) ABSTRACT

A mechanical chock has a pair of anchoring cams mounted in rotation and in opposition on a common support spindle. Each cam includes a bearing surface having a predetermined profile. The bearing surface of the first cam presents a convex face, whereas the bearing surface of the second cam has a concave face, so as to obtain three bearing points or zones in the separated blocking position.

4 Claims, 3 Drawing Sheets

MECHANICAL CHOCK WITH CAMS FOR CLIMBING AND MOUNTAINEERING

BACKGROUND OF THE INVENTION

The invention relates to a mechanical chock with cams for climbing and mountaineering, and comprising:

at least one pair of anchoring cams mounted in rotation and in opposition on a common support spindle, each cam comprising a bearing surface having a predetermined profile, an attachment means securedly affixed to a central body of the spindle, which is equipped with a first half-spindle for receiving the first cam and a second half-spindle for receiving the second cam, and means for operating the cams between a separated blocking position and a retracted releasing position.

STATE OF THE ART

FIG. 1 of the application corresponds to the mechanical chock illustrated in the document WO 02/34091, which comprises a pair of cams 11, 12 mounted in rotation in opposition on a single spindle 13. Each cam comprises two flat opposite side faces which bound the bearing surface having a curved profile in the form of a spiral. This bearing surface of each cam comes into contact with one of the walls of a crack to act as an anchor.

In a specific angular position of the bearing surface, the cross-section of the bearing surface is formed at this location by a straight line. In a regular crack (illustrated in FIG. 1 of the present application), the flat bearing surfaces substantially follow the outline of the walls of the crack and ensure efficient jamming of the chock. Use of this known chock in irregular cracks (FIG. 2) may give rise to problems of instability in the case where contact with the wall takes place at a single point on each side. Depending on the mechanical stresses exerted on the attachment rope, the chock is then liable to come unsecured by rotating around an axis passing through the two contact points A and B.

OBJECT OF THE INVENTION

The object of the invention is to remedy these shortcomings and to achieve a mechanical chock with cams enabling an optimum anchoring stability to be obtained regardless of the shape of the cracks.

According to the invention, this object is achieved by the fact that the bearing surface of the first cam presents a convex face, whereas the bearing surface of the second cam has a concave face, so as to obtain three bearing points or zones in the separated blocking position.

The two half-spindles are coaxial and the bearing surface of each cam has a logarithmic spiral profile with an angle of about 14°.

The operating means preferably comprise a trigger-pull-pull connected to the cams by a pair of connecting rods, said trigger-pull-pull being formed by a tubular sliding block the top end whereof is coupled to the rods and the bottom end whereof is shaped as a gripping means.

BRIEF DESCRIPTION OF THE DRAWINGS

Other advantages and features will become more clearly apparent from the following description of particular embodiments of the invention, given as non-restrictive examples only, and represented in the accompanying drawings in which.

DESCRIPTION OF A PREFERRED EMBODIMENT

Figure 1:
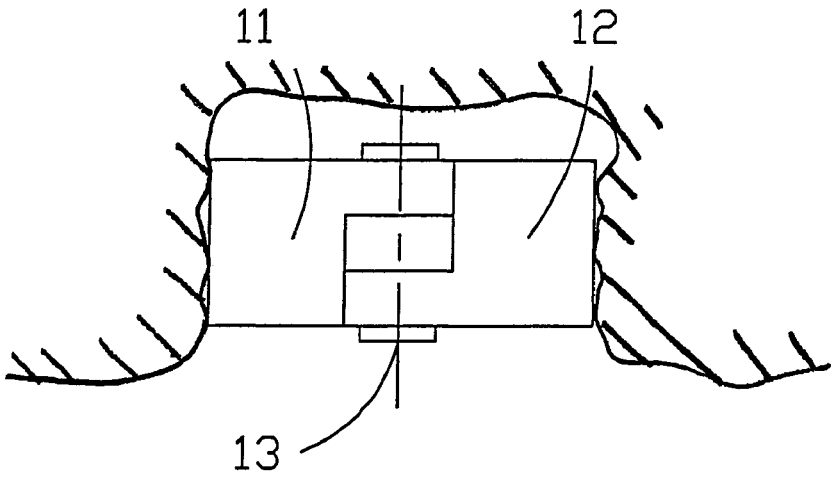
FIG 1 (prior art)
FIGS. 1 and 2 are views of a chock of the prior art, in the inserted position respectively in a regular crack and in an irregular crack.
Figure 2:
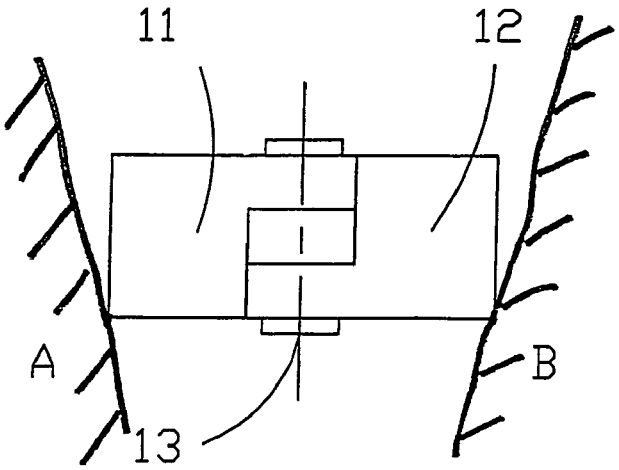
FIG 2 (prior art)

In FIGS. 3 to 6, a mechanical chock 10 with cams for climbing and mountaineering comprises a pair of anchoring cams 11, 12 mounted in rotation and in opposition on a common support spindle 13.

The support spindle 13 is fixed and comprises a central body 16 whereto a rope 14 or any other attachment means is attached. The end of the rope 14 is equipped with a ring 15 enabling a karabiner or a belaying rope to be attached.

The central body 16 of the spindle 13 is equipped with a first half-spindle 13*a* whereon the first cam 11 is mounted and with a second half-spindle 13*b* for receiving the second cam 12. The two half-spindles 13*a*, 13*b* are coaxial and extend on each side of the central body 16.

Each cam 11, 12 has a bearing surface having a logarithmic spiral profile with an angle of about 14°. The bearing surface 11*a* of the first cam 11 presents a convex face instead of being flat as in the chock of the document WO 02/34091. The other bearing surface 12*a* of the second cam 12 presents a concave face.

Figure 7:
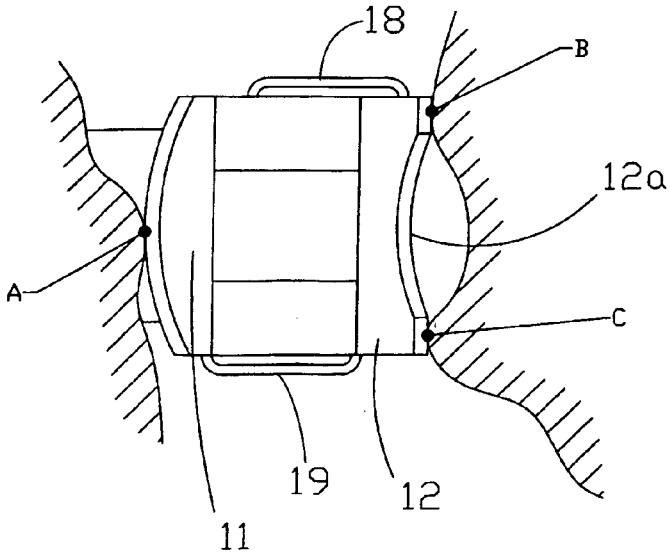
FIG. 7 represents a top plan view of the chock of FIG. 4 inserted in an irregular crack with non-parallel faces.

The curvatures of the two opposite bearing surfaces 11*a*, 12*a* are thus reversed so as to permanently provide three bearing points or zones A, B and C (figure 7). This results in a stable position of the chock 10 inserted in a crack of irregular shape, the bearing point A being located on the convex face side and the other two bearing points B and C on the concave face side.

Figure 4:
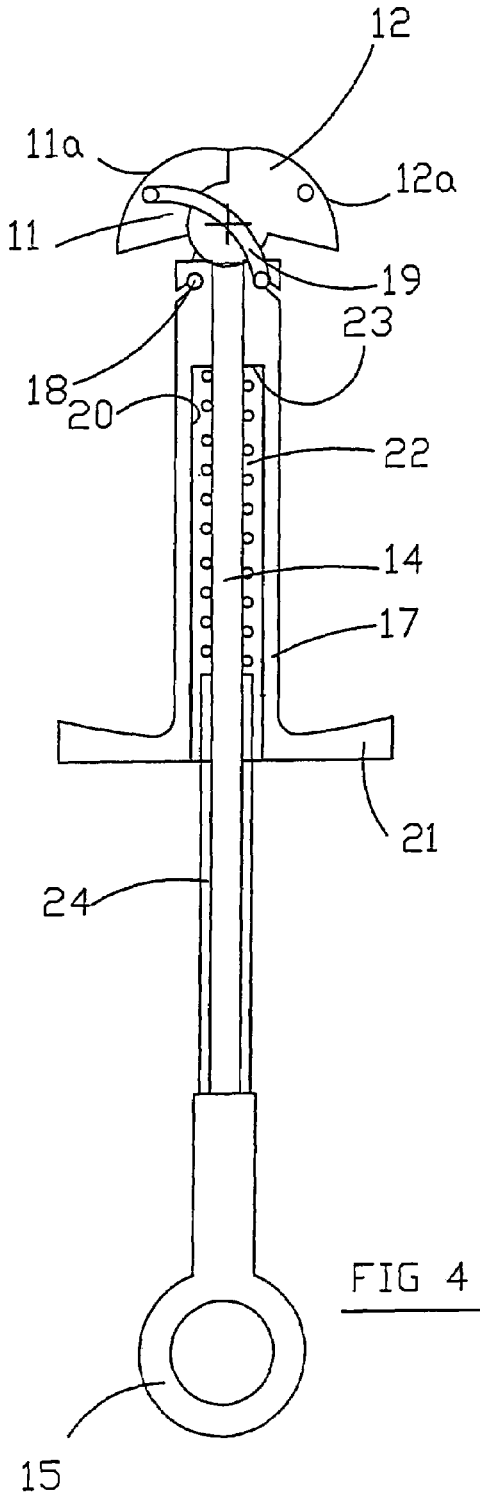
FIGS. 3 and 4 show cross-sectional views of a chock according to the invention, represented respectively in the retracted position for insertion in a crack and in the separated blocking position.

A torsion spring (not shown) is fitted on one of the half-spindles 13*a*, 13*b*, and biases the cams 11, 12 to the separated blocking position of FIG. 4.

Figure 3:
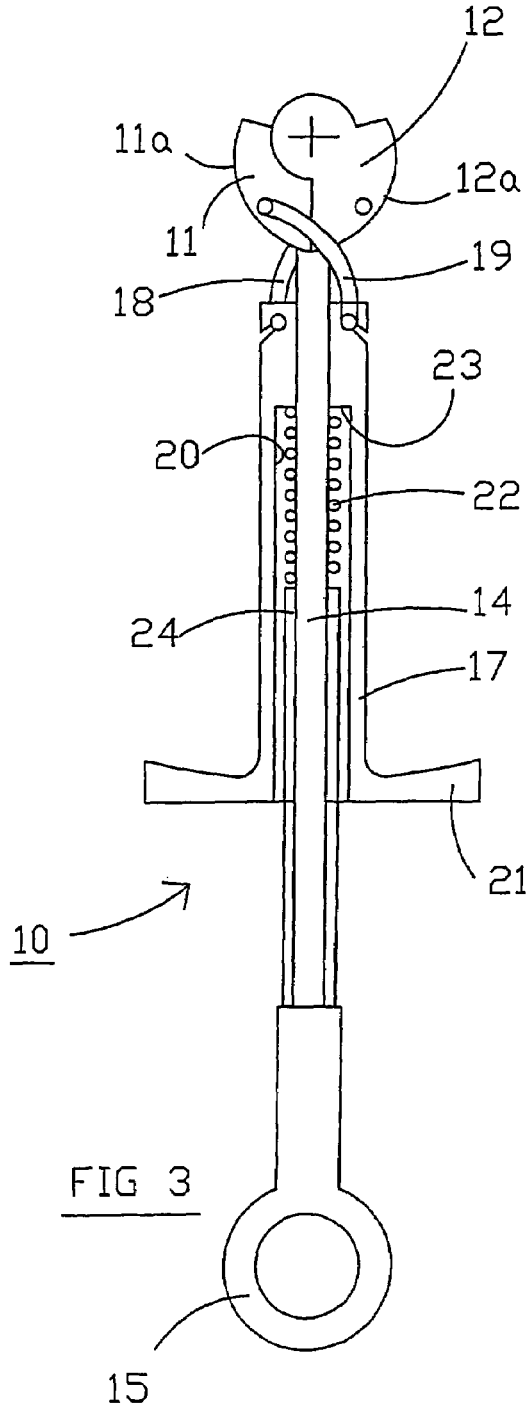
Figure 5:
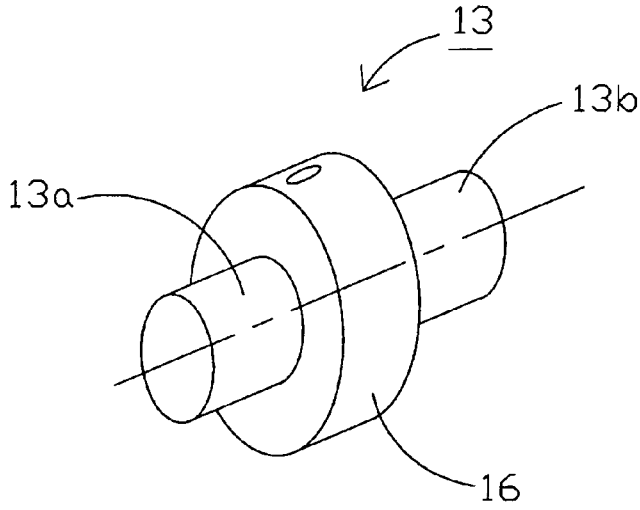
FIG. 5 is a perspective view of the cam support spindle.
Figure 6:
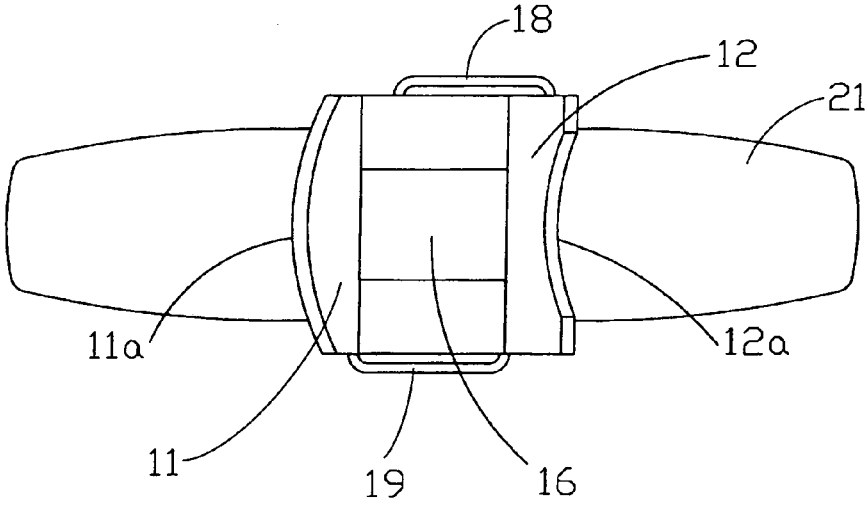
FIG. 6 is a top plan view of the chock of FIG. 3.

Movement of the cams 11, 12 to the retracted position of FIG. 3 is achieved by means of a trigger-pull-pull 17 connected to the cams 11, 12 by a pair of connecting rods 18, 19. The trigger-pull 17 comprises a tubular sliding block 20 the top end whereof is coupled to the connecting rods 18, 19 and the bottom end whereof is shaped as a gripping means 21.

A compression spring 22 is fitted between an internal shoulder 23 of the sliding block 20 and a tubular stop 24 inserted on the rope 14 when assembly is performed. To position the chock 10 in a crack, the gripping means 21 simply has to be pulled downwards to compress the compression spring 22 and actuate the cams 11, 12 to the retracted position of FIG. 3.

If the gripping means 21 is released, expansion of the compression spring 22 automatically moves the trigger-pull 17 back upwards, and the torsion spring causes the cams to return to the separated blocking position (FIG. 4).

The invention claimed is:

1. Mechanical chock with cams for climbing and mountaineering, comprising:

at least one pair of anchoring cams, including a first cam and a second cam, mounted in rotation and in opposition on a common support axle member, each cam comprising a bearing surface of predetermined profile to contact a wall of a crack to act as an anchor;

an attachment means securedly affixed to a central body of the support axle member, the central body having a first half-spindle for receiving the first cam and a second half-spindle for receiving the second cam;

and means for operating the cams between a separated blocking position and a retracted releasing position, the operating means comprising a trigger-pull connected to the cams by a pair of connecting rods, said trigger-pull being formed by a tubular sliding block the top end of which is coupled to the rods and the bottom end of which is shaped as a gaping means, wherein the bearing surface of the first cam presents a convex face, and the bearing surface of the second cam has a concave face, so as to obtain three bearing points or zones in the separated blocking position, wherein the first half-spindle and the second half-spindle are coaxial.

2. Chock according to claim 1, wherein the bearing surface of each cam has a logarithmic spiral profile with an angle of about 14°.

3. Chock according to claim 1, wherein a compression spring is fitted between an internal shoulder of the sliding block and a tubular stop inserted on the attachment means.

4. Chock according to claim 3, wherein the attachment means are formed by a rope equipped with a ring.

* * * * *